US007243475B1

(12) United States Patent
Cady

(10) Patent No.: US 7,243,475 B1
(45) Date of Patent: Jul. 17, 2007

(54) BAGGER OR BAG DISPENSER WITH REVERSIBLE TAKE-UP REEL AND METHOD

(75) Inventor: Derril R. Cady, Manawa, WI (US)

(73) Assignee: Greydon, Inc., York, PA (US)

( * ) Notice: Subject to any disclaimer, the term of this patent is extended or adjusted under 35 U.S.C. 154(b) by 0 days.

(21) Appl. No.: 11/334,097

(22) Filed: Jan. 18, 2006

Related U.S. Application Data

(60) Provisional application No. 60/718,523, filed on Sep. 19, 2005.

(51) Int. Cl.
*B65B 43/12* (2006.01)

(52) U.S. Cl. ..... 53/250; 53/249; 53/384.1

(58) Field of Classification Search ..... 242/613, 242/613.1, 613.2, 613.3, 613.4, 613.5; 53/473, 53/475, 249, 250, 384.1
See application file for complete search history.

(56) References Cited

U.S. PATENT DOCUMENTS

| | | | | |
|---|---|---|---|---|
| 2,225,180 | A * | 12/1940 | Olesen | 242/613.1 |
| 2,283,626 | A * | 5/1942 | Freydberg | 242/525.2 |
| 2,743,098 | A * | 4/1956 | Berquist | 242/613.2 |
| 3,307,800 | A * | 3/1967 | Macedo | 242/613.1 |
| 3,330,499 | A * | 7/1967 | Gooding | 242/613.1 |
| 3,406,592 | A | 10/1968 | Von Kaler | 74/710 |
| 3,587,843 | A | 6/1971 | Wing | 206/57 |
| 3,698,547 | A | 10/1972 | Roberts et al. | 206/57 |
| 3,856,229 | A * | 12/1974 | Byram | 242/613.1 |
| 3,908,343 | A | 9/1975 | Farrelly | 53/385 |
| 4,032,038 | A | 6/1977 | Hendricks et al. | 221/71 |
| 4,693,372 | A | 9/1987 | O'Neill | 206/554 |
| 4,796,412 | A * | 1/1989 | O'Neill | 53/250 |
| 5,956,929 | A | 9/1999 | Yisha et al. | 53/459 |
| 6,102,319 | A * | 8/2000 | Annabel et al. | 242/613.1 |
| 6,470,648 | B1 | 10/2002 | Baker | 53/411 |
| 6,742,317 | B2 | 6/2004 | Cronauer et al. | 53/411 |
| 6,834,472 | B2 | 12/2004 | Kujubu et al. | 53/64 |
| 6,837,023 | B1 * | 1/2005 | Glatfelter, Jr. | 53/64 |
| 2002/0130058 | A1 * | 9/2002 | Carson et al. | 383/37 |
| 2006/0151658 | A1 * | 7/2006 | Palumbo | 242/528 |

FOREIGN PATENT DOCUMENTS

| | | | |
|---|---|---|---|
| GB | 2064477 | A | 6/1981 |

* cited by examiner

*Primary Examiner*—Louis Huynh
(74) *Attorney, Agent, or Firm*—Hooker & Habib, P.C.

(57) ABSTRACT

An improved bagger or bag dispenser for supplying bags attached to strips in a bag assembly to a workstation includes a reversible drive that pulls the bag assembly from a supply to the work station and returns unused bags to the supply when changing bag assemblies. The bagger includes a winding spool having tapered ribs and valleys.

20 Claims, 6 Drawing Sheets

BAGGER OR BAG DISPENSER WITH REVERSIBLE TAKE-UP REEL AND METHOD

This application claims the benefit of U.S. Provisional Application No. 60/718,523 filed Sep. 19, 2005.

FIELD OF THE INVENTION

The invention relates to bag dispensers or baggers that supply bags to a workstation, and in particular to bag dispensers or baggers in which the lead end of a bag assembly is wound on to a take-up reel or roller and related methods.

BACKGROUND OF THE INVENTION

Foods products, such as meat, cheese and the like, are conventionally packaged in plastic bags at workstations. Packaged foods products must carry product information such as packaging date and product source information. Product information is commonly printed on the bags.

Baggers or bag dispensers that supply printed bags to workstations are available. These devices include a drive that moves the bags from a supply of bags to the workstation. The bags pass a printer that prints product information on exposed sides of the bags before the bags reach the workstation.

Bags are supplied by the manufacturer as an indefinite-length bag assembly, either as a roll of bags or as a shingled bag assembly stored in a box. The bags are spaced along the length of the bag assembly. With shingled bag assemblies, lead ends of the bags are adhered to tape strips and trailing ends overlie each other. The tape strips are fed through the device from the box to the workstation. The bags are removed from the tape strips at the workstation.

Glatfelter, Jr. U.S. Pat. No. 6,837,023, assigned to the common assignee of this application, is incorporated herein by reference and discloses a bagger that is intended for high-production workstations where product is automatically bagged and sealed. The bagger reliably prints product information on bags of a shingled bag assembly. The two tape strips on the lead end of the bag assembly are attached to a take-up reel so that rotation of the reel by a drive motor pulls the bag assembly to the workstation. The tape strips are wound on the reel as the bag assembly is pulled through the bagger.

Workstations typically process production runs requiring different size bags for different size products. The bagger described in U.S. Pat. No. 6,837,023 is intended to be used with different size bags. When changing bag assemblies to change bag size the tape strips of the installed bag assembly are cut near or at the take-up reel, the bags on the lead end of the installed bag assembly are stripped off the tape strips and the assembly is removed from the bagger. The strips at the lead end of the removed assembly can easily be wound onto the reel when the assembly is reinstalled in the bagger. A new bag assembly with different sized bags is then installed in the bagger. The unused bags stripped from the removed bag assembly are discarded and wasted.

Conventional bag dispenser take-up reels are rotated by air ratchet drive motors. This type motor rotates the take-up reel through a fixed angle per each ratcheting motion. Each extension of an air cylinder advances the bag assembly a predetermined distance, typically about 0.25 inches. The operator cannot adjust this distance to correct the position of a bag assembly misaligned at the printer or the loading station.

Conventional take-up reels pull each tape strip in unison. After prolonged operation, one tape strip will often lag behind the other as the strips wind onto the reel. Tape strip lagging causes bags on the assembly to become misaligned at the printer or the loading station and may cause jams in the dispenser.

The bags are expensive. It is desirable to reduce operating cost by eliminating bag waste during operation of the bagger and when changing from one bag assembly to another.

SUMMARY OF THE INVENTION

The invention is an improved bagger or bag dispenser in which the drive that pulls the bag assembly through the machine is reversible to unwind tape strips from the reel and permit return of unused bags to the box or back on the roll when changing bag assemblies. No bags are wasted when changing from one size bag assembly to another. Printed bags that are returned can have the prior printing wiped off or otherwise erased or covered for later re-printing. The weight of the bag assembly assists in unwinding the tape strips from the take-up reel. The path of the bag assembly through the device is configured such that the weight of the bag assembly assists in moving the bag assembly in the reverse direction past the printer and back to the supply.

The two tape strips are wound to form strip rings on the take-up reel. The reel preferably includes two spools specialized to facilitate winding and removal of wound tape strips. The spools are preferably made from thermoplastic plastic material to reduce adhesion to the wound tape strips and have circumferentially-spaced, outwardly or inwardly tapered ribs that support the strip rings and reduce the surface area contacting the strips. The tapered ribs facilitate tape winding and define grooves that allow easy removal of wound tape rings.

A reversible air stepper motor is used to rotate the reel. The air stepper motor allows fine control of take-up reel rotation, allows the operator to control the position of bags on the bag dispenser with high accuracy and allows reverse rotation of the reel to permit unwinding of tape strips from the rings during changeover from one size bag assembly to another size bag assembly.

The take-up reel has left and right spools and a differential spool drive that permits rotation of each spool at a differential speed to take-up tape strip slack when one tape strip lags behind the other tape strip.

Baggers or bag dispensers in accordance with the present invention reduce waste making it easier and more efficient to change bag assemblies and facilitate removal of strip rings. Other objects and features of the invention will become apparent as the description proceeds, especially when taken in conjunction with the accompanying drawings illustrating the invention, of which there are six sheets of drawings of two embodiments.

DESCRIPTION OF THE PREFERRED EMBODIMENTS

Figure 1:
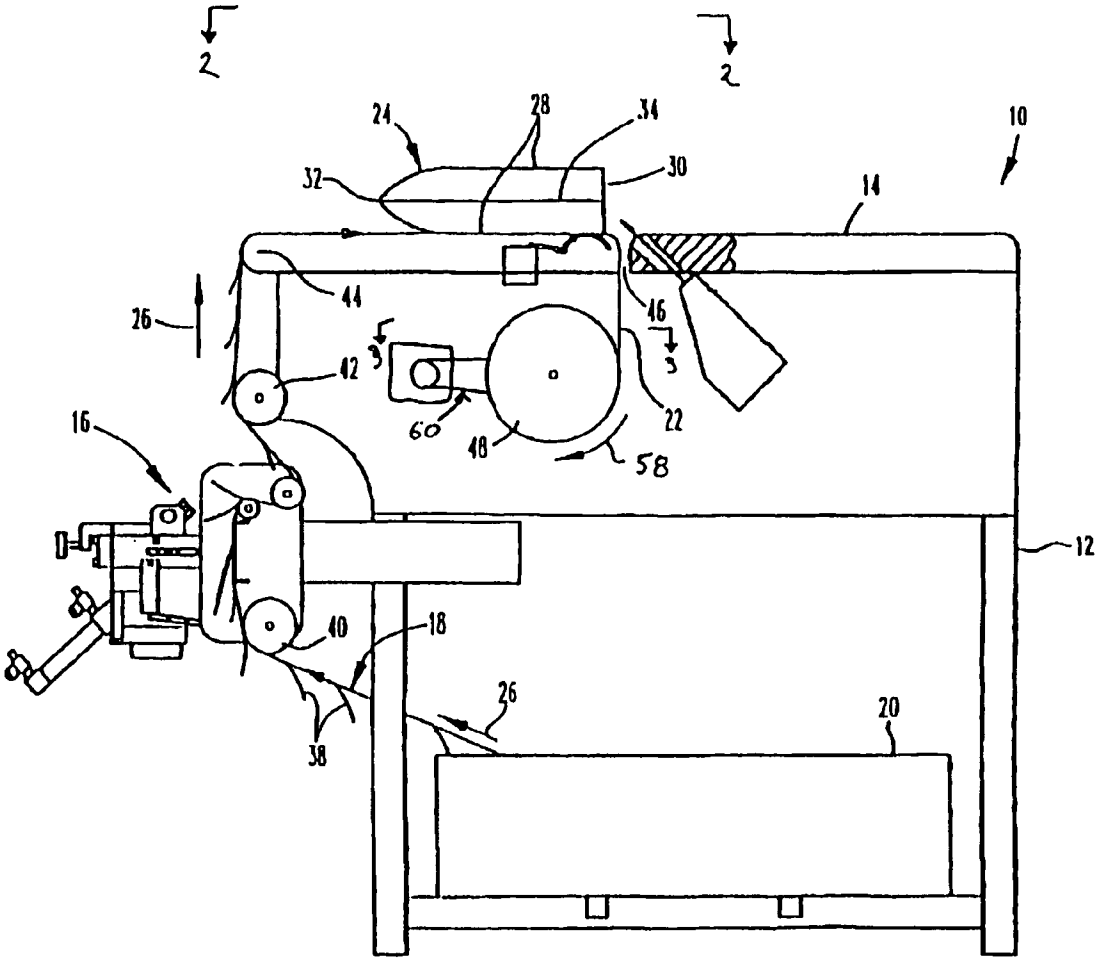
FIG. 1 is a side view, partially broken away, of a bagger in accordance with the present invention.
Figure 2:
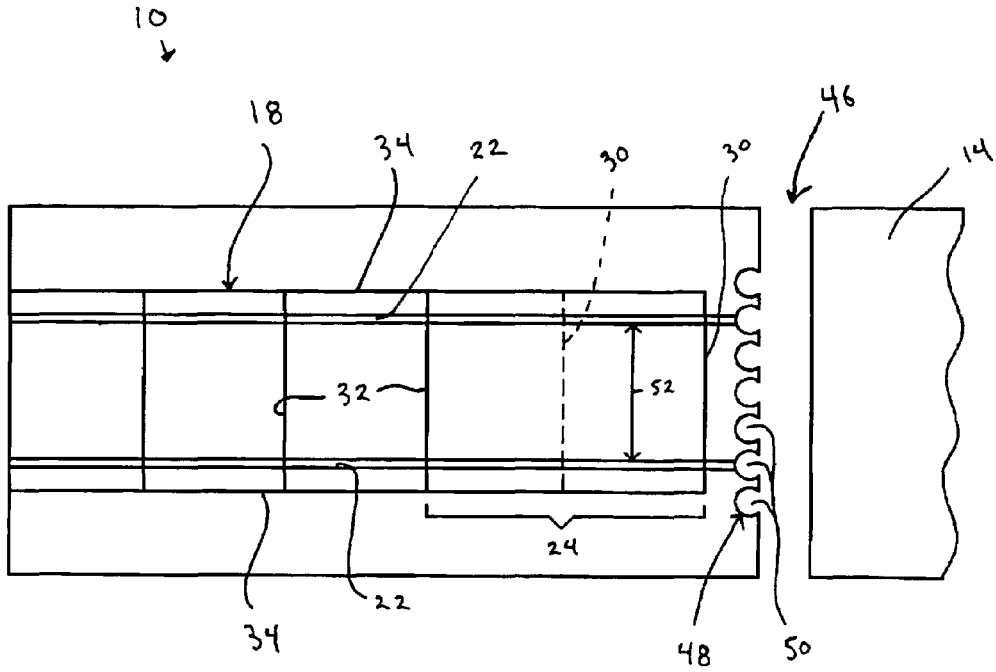
FIG. 2 is a top view of the view of the bagger taken along line 2—2 of FIG. 1.

FIG. 1 illustrates bagger 10 having a frame 12, a workstation 14 at the top of the frame and a bag printer assembly 16 mounted on one side of frame 12. An indefinite length shingled bag assembly 18 is fed from box 20 mounted on the bottom of frame 12, through printer assembly 16 and to station 14. The printer assembly prints desired information, typically date and source information, on each bag in the bag assembly.

Bag assembly 18 includes two spaced, parallel indefinite length adhesive tape strips 22. A plurality of generally rectangular shingled plastic bags 24 is adhered to strips 22. The assembly 18 is fed downstream from box 20 to station 14 in the direction of arrow 26. Each bag 24 is made from thin plastic film and has opposed sides 28, an open lead end 30, sealed trailing end 32 and sealed edges 34 extending between ends 30 and 32.

As shown in FIG. 1, bag assembly 18 is fed from box 20 to printer assembly 16 with strips 22 on the top of the bag assembly and bag upstream or trailing portions 38 hanging down from the bottom of the assembly. The bag assembly is fed around lower roller 40, through printer assembly 16, around upper roller 42, around the rounded edge 44 of workstation 14 and to slot 46 extending access the workstation.

At slot 46, tape strips 22 are fed through selected guide recesses 50 in comb 48. Recesses 50 facilitate feeding bag assemblies having tape strips with different spacing 52. The recesses locate strip rings at desired locations on the elongate spools in the reel assembly.

Strips 22 extend through comb 48 and are wound on reel assembly 54. Reversible drive motor 56 rotates reel assembly 54 in the direction of arrow 58 to feed bag assembly 18 from box 20, through printer assembly 16 and to station 14. Reversible motor 56 rotates reel assembly 54 via a belt drive 60 that includes a belt 62 extending from motor drive pulley or input member 64 to a driven differential wheel 66 on differential 68 of reel assembly 54. See FIG. 3. Belt 62 includes teeth 63 which engage grooves on pulley 64 and wheel 66.

Motor 56 selectively drives reel assembly 54 in response to control circuitry in a forward direction of rotation indicated by arrow 58 or in an opposite, reverse direction of rotation. A control circuit (not shown) enables a user to rotate the reel in a winding operating mode for supplying printed bags to workstation 14 or in a unwinding operating mode to remove or change bag assemblies.

If desired, motor 56 may be a pneumatic stepper motor that allows the tape strips 22 to be advanced along bagger 10 and wound around reel assembly 54 at precisely controlled distances or steps of as fine as 0.001 inch. The pneumatic stepper motor allows precise positioning of each bag 24 for printing and/or loading by bagger 10. An electric stepper motor mat be used if desired.

The control circuitry may include a programmable logic controller (PLC) to control the pneumatic stepper motor 56.

Reel assembly 54 has left and right reel halves 70 and 72 and a central differential assembly 76. Each reel half has a drive shaft 74 extending the length of the reel half. Each shaft is connected to one output connection of differential 68 in assembly 76. The differential assembly and shafts are rotatably supported on inboard bearing wall 78 and 80 mounted on frame 12. Shafts 74 are coaxial.

Figure 3:
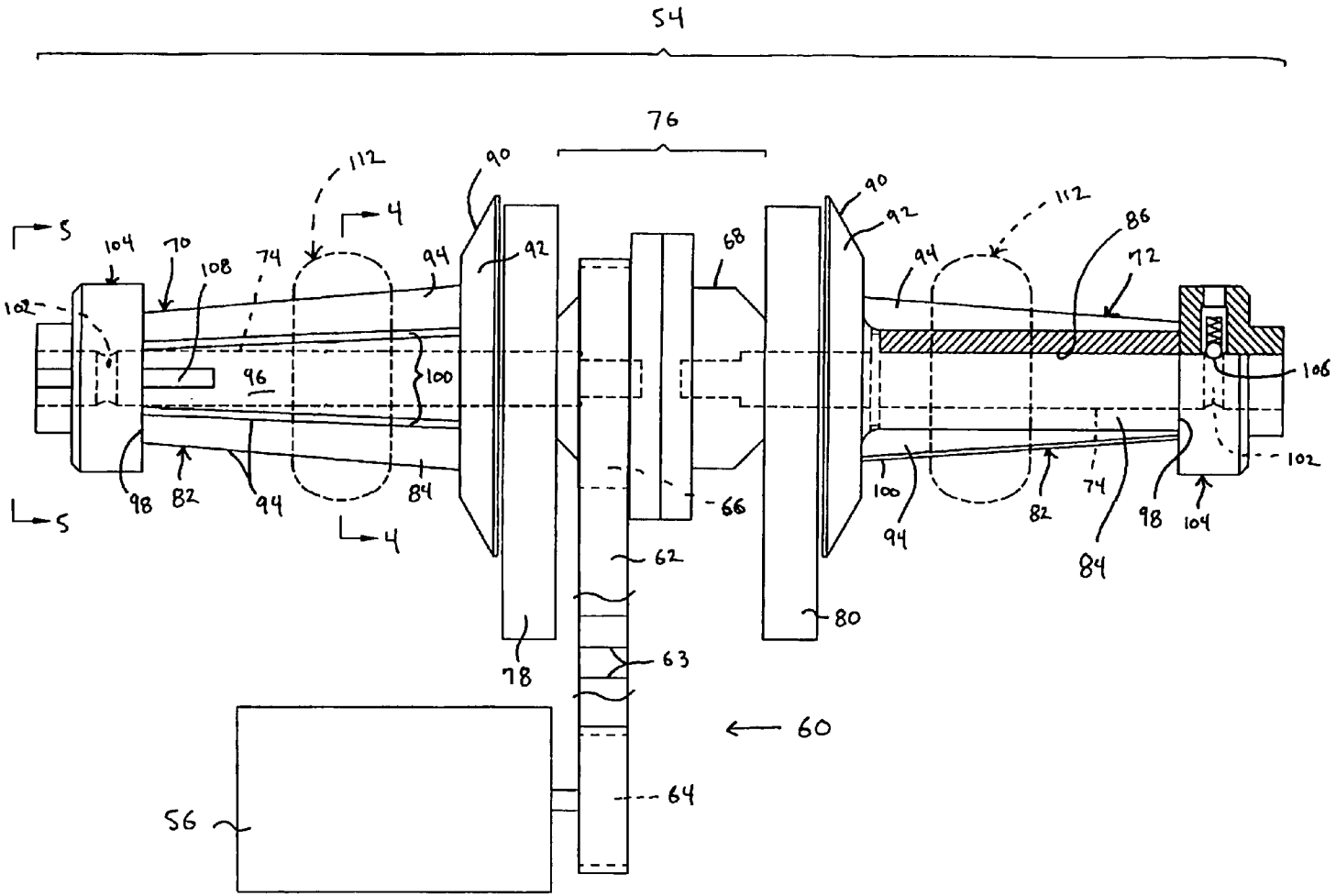
FIG. 3 is a top view of the take-up reel taken generally along line 3—3 of FIG. 1.
Figure 4:
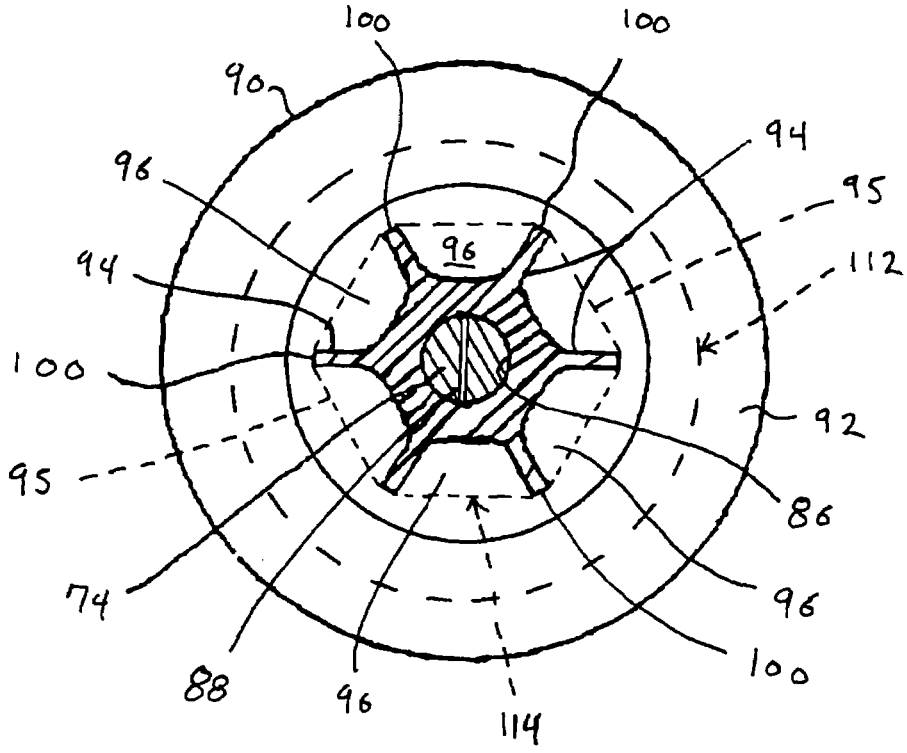
FIG. 4 is a sectional view taken along line 4—4 of FIG. 3.

Each reel half 70, 72 includes a tape winding spool 82 mounted on the end of shaft 74 extending outwardly from a bearing wall 78, 80. Each winding spool 82 includes an elongate body 84 defining a cylindrical shaft passage 86 having a sliding fit on shaft 74. Cross pin 88 extends through body 84 and shaft 74 to assure that the winding spool 82 rotates with shaft 74. See FIG. 4. A circular inner flange 90 extends radially outwardly from the inner end of body 84 adjacent a bearing wall 78, 80. As shown in FIG. 3, flange 90 has an inner side at the adjacent wall 78, 80 and outwardly tapered circumferential surface 92 extending from the edge of the flange radially inwardly and away from the adjacent wall. See FIGS. 3 and 4.

Six 60 degree-spaced longitudinally tape-winding ribs 94 extend radially outwardly from body 84 and from flange 90 to outer body end 98. As shown in FIG. 3, the ribs 94 taper radially inwardly from flange 90 to end 98 to define six straight, tapered tape-winding surfaces 100. The surfaces 100 faces radially outwardly and are equally spaced around the spool. Six longitudinal recesses or valleys 96 are located between adjacent ribs 94. Strip rings 112 are wounded on surfaces 100 and have different interior diameters depending upon where the rings are located along the spools.

Figure 5:
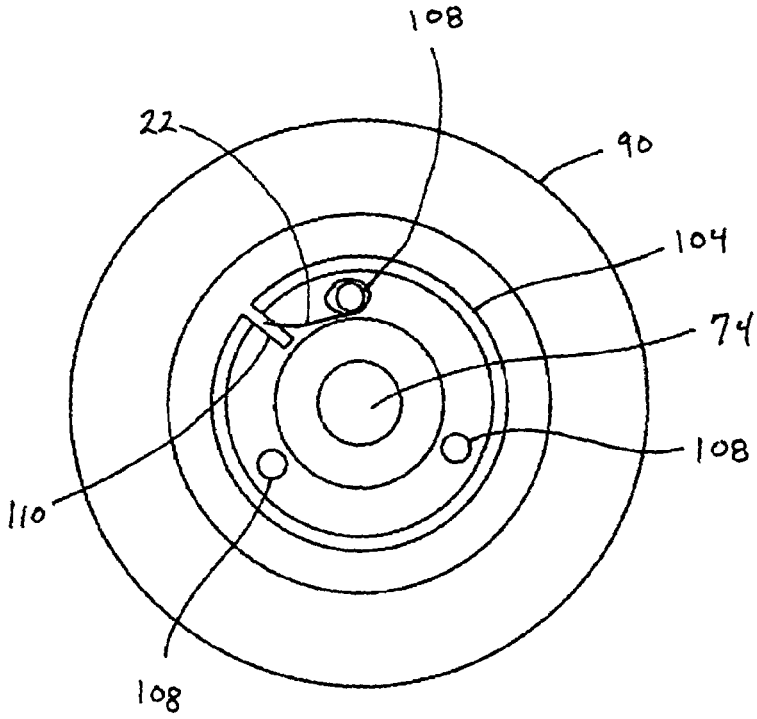
FIG. 5 is a sectional view taken along line 5—5 of FIG. 3.

Shaft 74 extends beyond spool end 98 and is provided with a circumferential detent groove 102 located outwardly from end 98. Optional spool end cap 104 is mounted on the free end of shaft 74 and carries a spring detent 106 engageable with groove 102 to hold the cap in place on the shaft. End cap 104 extends outwardly from shaft 74 and beyond the outer ends of tape-winding ribs 94. Three 120 degree-spaced pins 108 extend through cap 104 parallel to the axis of shaft 74. The inner ends of the pins 108 fit into valleys 96 between adjacent winding ribs 94 on body 84 to prevent rotation of the cap on the body. The outer ends of the pins extend outwardly beyond the cap to provide tie offs for the end of a tape strip wound on the spool. Radial slot 110 extends inwardly from the outer circumference of cap 104 to facilitate leading the strip end to an adjacent tie off pin 108 as illustrated in FIG. 5.

The operation of bagger 10 will now be described.

The bag assembly 18 is loaded on the machine by drawing the assembly from box 20 or a reel mounted on the frame, feeding the assembly through printer 16 and leading the assembly around edge 44 onto workstation 14. A number of bags at the lead end of the assembly are removed from strips 22. The strips are positioned in appropriately spaced recesses 50 in comb 48. Each strip is then wound several times around a body 84 of an underlying winding spool 82 against the winding surfaces 100 on ribs 94. Then, the free ends of the strips 22 are fed through slots 110 in end caps 104 and tied off onto the outer ends of pins 108 extending through the end caps. If end caps 104 are not used, the ends of the tape strip are fed through slots in the outer ends of the spools and held in recesses in the spool ends. Winding of the strips on to the spools may be facilitated by lifting up the portion of the workstation 14 to the right of slot 46 as shown in FIG. 1 to provide access to the spools.

With the tape assembly in place in the machine, bagging operations are commenced as described in U.S. Pat. No. 6,837,023. Initial actuation of air motor 56 rotates the spools 82 in a winding direction to take-up slack in one or both strips 22 prior to feeding the bag assembly past printer 16 and onto the workstation 14.

With continued operation of machine 10 the two strips 22 are wound onto the two winding spools 82 to form wound generally circular strip rings 112. Each ring 112 is formed by a number of loops of adhesive tape strip 22 wound around a spool and adhered to each other. The strip forming each ring 112 is wound on the thin winding surfaces 100 at the ends of the six winding ribs 94 and has a generally hexagonal inner surface 114 defined by ribs 94 with straight cords 95 extending between adjacent ribs. The tape strips have low area contact with the winding spool 82 to facilitate removal of the strip ring from the spool. During winding, the location of the recess 50 guiding the strip to the spool and adhesive engagement with the ribs prevent the strip ring from migrating along the spool 82.

The winding strip rings 112 are easily removed from spools 82 when machine 10 is deactivated. For instance, it may be desirable to remove the rings when they have grown to a maximum size prior to depletion of all of the bags in assembly 18. In this case, motor 56 is reversed to unwind a length of strip from each of the rings. The rings are then severed from the unwound strips and caps 104 are removed from shafts 74. The ends of the strips extending from the rings to the caps are cut away and discarded. The strip rings 112 are then easily removed from the winding spools by positioning a tool or the operator's fingers in valleys 96 between the strip rings and flanges 90 and withdrawing the strip rings from the spools. The height of ribs 94 decreases outwardly from the flanges 90 to assure that the strip rings, once dislodged from their winding positions, are free of the ribs during withdrawal. After the strip rings have been removed, the free ends of the strips extending from the bag assembly in machine 10 are reattached to the spools as previously described.

Change over from a bag assembly having strips at one spacing 52 to a bag assembly having strips at a different spacing 52 is easily accommodated without waste of bags. In this case, motor 56 is operated in a reverse direction to unwind sufficient lengths of strips from the strip rings to permit reverse feeding of the bag assembly back into the box without need for removing and discarding bags from the lead end of the assembly. The prior strip rings are removed and a new bag assembly with different spacing strips 22 is then installed as previously described.

Figure 6:
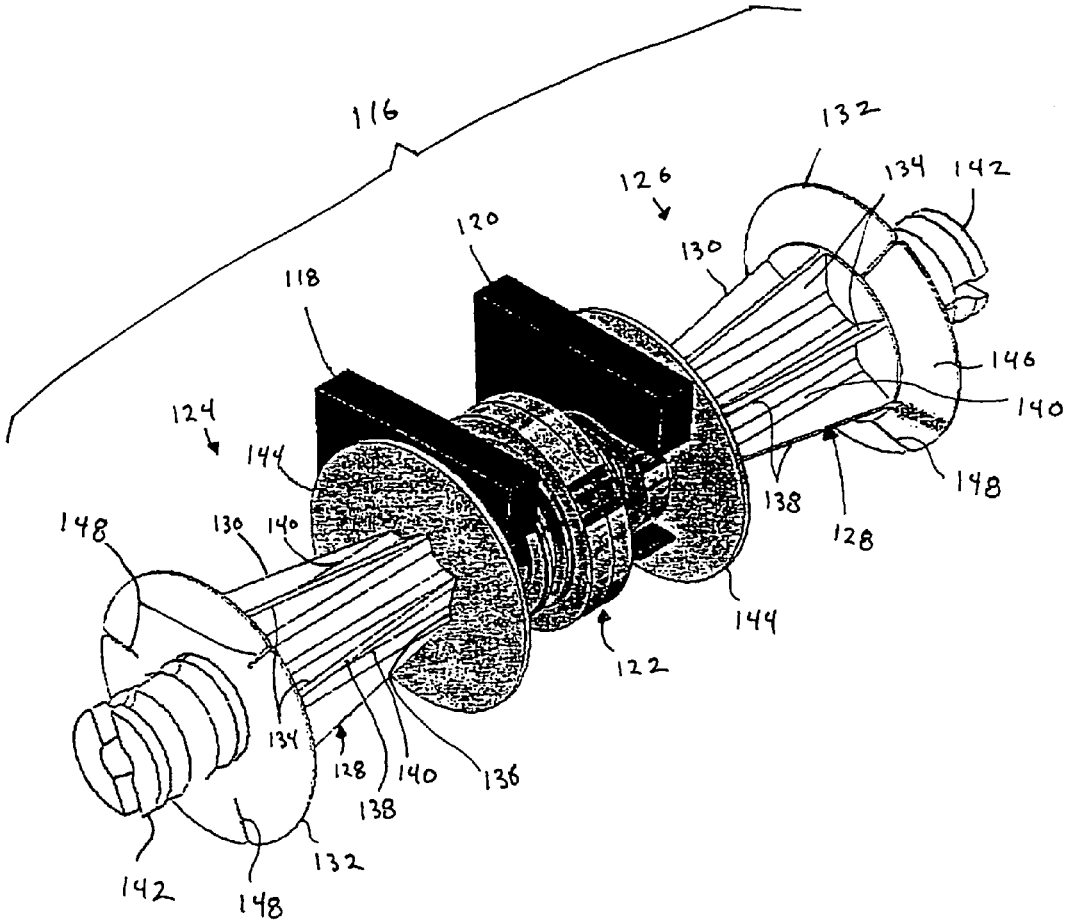
FIG. 6 is a perspective view of a second embodiment take-up reel for a second embodiment bagger.

FIG. 6 illustrates a second embodiment take-up reel assembly 116 similar to reel assembly 54. Like reel assembly 54, reel assembly 116 is mounted on frame 12 by bearing walls 118 and 120 and includes a differential assembly 122, like assembly 76, and left and right reel half 124 and 126, like halves 70 and 72. Each reel half has a drive shaft (not illustrated), like shaft 74, joined to the differential and extending outwardly from the adjacent bearing wall.

Each reel half includes a winding spool 128 on a shaft extending outwardly from the differential assembly. Each spool 128 includes an elongate body 130 with the shaft extending into a cylindrical passage in the center of the body. The body includes an outer circumferential flange 132 and six 60 degree-spaced radial ribs 134 extending longitudinal from flange 132 inwardly to the inner end 136 of the body. The tape winding ribs 134 have narrow, straight tape winding surfaces 138 at the outer ends thereof, like surfaces 100. Surfaces 138 taper radially inwardly from flange 132 to end 136. Valleys 140, like valleys 96, extend longitudinally between adjacent ribs 134.

Body 130 includes a handle 142 which extends outwardly from outer flange 132 and a spring detent (not illustrated) which engages a detent groove on the end of the shaft extending from the differential. The spring detent prevents accidental outward displacement of body 130 from the shaft. Inner circumferential flange 144 is mounted on the shaft and rotates with the shaft. When positioned on the shaft, the inner end 136 of body 130 engages a surface on flange 144 so that body 130 rotates with the shaft. The spring detent engagement between handle 142 and the shaft prevents disengagement of the rotary drive connection between the flange and body.

The take-up reel assembly 116 is rotated by a pneumatic step motor (not illustrated) similar to motor 56 through a drive belt (not illustrated) like belt 62. The belt is wound around an output pulley on the motor and a drive wheel on differential assembly 122, as illustrated in FIG. 3.

Flange 132 includes an inwardly sloping conical surface 146 extending from the outer edge of the flange radially inwardly and toward the adjacent bearing wall 118, 120. Tape strip slots 148 are formed through the outer portion of flanges 132.

The operation of a bagger with a second embodiment take-up reel assembly 116 will not be described.

The bag assembly is fed into machine 10 as described. Elongate tape strips from the lead end of the assembly are positioned in proper comb recesses 50 and wound around the ribs of each winding spool. The ends of the tape strips for each spool are fed through slots 148 in the outer flanges 132 and secured to handles 142. The machine may then be operated as described with tape strips wound up on the reels to form generally circular strip rings like rings 112 engaging tape winding surfaces 138 on the ribs and having generally hexagonal inner surfaces like surfaces 114.

When it is desired to remove the winding strip rings from the reels, the motor is reversed to unwind desired lengths of tape strips. The motor is then deactivated and the unwound length of tape strips and the tied off ends are severed from the strip rings. The winding spools 128 are then removed from the drive shafts and the strip rings are removed from the ribs by positioning a tool or the operator's fingers in the valleys between the ribs adjacent flange 132 and sliding the strip rings longitudinally past the inner body end 136.

Following removal of the strip rings, the take-up reels are repositioned on the shafts with the inner ends 136 engaging rotary drive surfaces on inner flanges 144 and the spring detents seated in grooves in the ends of the shafts. The unwound tape strips are wound on the reels and secured to the handles as previously described for continued operation of the machine.

Conical surfaces 92 on flanges 90 and conical surface 146 on flanges 132 guide strips wound onto the reels, particularly during take-up of slack strips after strip rings have been removed or a new bag assembly has been installed.

The ribs in both spools 82 and 128 taper radially inwardly along the length of the spools to the small diameter ends of the spools to facilitate easy removal of strip rings wound on the spools independently of the longitudinal positions of the rings on the spools.

The winding spools and flanges are preferably formed from thermoplastic material but may be formed from metal or other material, as desired.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A device for supplying successive bags from an indefinite length bag assembly to a workstation, the bag assembly having a pair of tape strips and a plurality of bags spaced along the strips, the device comprising;

a reel assembly for winding tape strips from the lead end of the bag assembly to pull the bag assembly along a path of travel to the workstation and position successive lead bags in the assembly at the workstation, the reel assembly including a first spool for winding a first tape strip in the bag assembly, and a second spool for winding a second tape strip in the bag assembly, each spool including an elongate body, one or more elongate and tapered tape winding surfaces spaced around and extending along the body for winding strip rings at different locations along the length of the body, and one or more strip ring removal recesses, each recess extending along the length of the body from a large diameter body end to a small diameter body end;

an operative drive having an input member and an output member connecting the input member and each spool;

a drive motor; and a drive connection between the drive motor and the input member.

2. The device as in claim 1 wherein each spool includes a plurality of ribs spaced around and extending outwardly from the body, each tape winding surface located on the outer end of a rib; and each recess comprises a tape winding valley located between a pair of adjacent ribs and extending from the large diameter body end to the small diameter body end.

3. The device as in claim 1 wherein each spool includes a flange at the large diameter end of the body, the flange extending radially outwardly beyond the ribs on the body.

4. The device as in claim 3 wherein each flange includes a tapered surface outwardly of the tape winding surfaces.

5. The device as in claim 4 wherein said spools are coaxial and the drive connection includes a differential.

6. The device as in claim 3 wherein each spool is coaxial with the other spool and said small diameter body ends are located adjacent the outer ends of the reel assembly and the large diameter body ends are located adjacent each other, said drive connection located between said spools.

7. The device as in claim 6 including a generally circular strip ring on each spool, each ring engaging the tape winding surfaces on the spool only and comprising a number of loops of adhesive tape strip wound around the spool and adhered to each other.

8. The device as in claim 1 including a generally circular strip ring on each spool, each ring engaging the tape winding surfaces on the spool only and comprising a number of loops of adhesive tape strip wound around the spool and adhered to each other.

9. The device as in claim 1 wherein the motor comprises a reversible motor.

10. The device as in claim 1 wherein the motor comprises a reversible air stepper motor.

11. A device for supplying successive bags from an indefinite length bag assembly to a workstation, the bag assembly having a pair of tape strips and a plurality of bags spaced along the strips, the device comprising, a reel assembly for winding strips from the lead end of the bag assembly to pull the bag assembly along a path of travel to the workstation and position successive lead bags in the assembly at the workstation, the reel assembly including a pair of winding spools, a motor, an operative drive connecting the motor and the winding spools wherein the motor rotates the spools to wind up one tape strip on each spool;

each spool including an elongate body, a plurality of elongate ribs spaced around and extending along the body, elongate tape winding surfaces on the ends of the ribs away from the body; and a plurality of elongate strip ring removal valleys spaced around and extending along the body between the ribs, the ribs of each spool tapering inwardly from a first large diameter body end to a second small diameter body end; and the valleys opening at the small diameter body end to facilitate removal of strip rings wound on the spool;

wherein rotation of the spools by the motor winds the tapes on the tape winding surfaces at selected locations along the spools to form strip rings.

12. The device as in claim 11 wherein the spools are coaxial with each other and the ribs on the spools are tapered in opposite directions along the axis.

13. The device as in claim 12 wherein the distance between the first large diameter body ends is less than the distance between the second small diameter body ends.

14. The device as in claim 12 wherein the distance between the second small diameter body ends is less than the distance between the first large diameter body ends.

15. The device as in claim 13 including a flange at the first large diameter end of each spool, each flange extending outwardly beyond the ribs on the spool.

16. The device as in claim 15 wherein each flange comprising a generally conical surface located outwardly from the ribs.

17. The device as in claim 11 including a flange at one end of each spool, each flange extending outwardly beyond the spool ribs.

18. The device as in claim 11 including a strip ring surrounding each spool, each strip ring including a polygonal innersurface contacting the winding surfaces on the ribs only and extending over the valleys between the ribs.

19. The device as in claim 11 wherein the motor is reversible to rotate the spools in winding and unwinding directions.

20. The device as in claim 11 wherein the motor is a reversible air motor.

* * * * *